US005113603A

United States Patent [19]

Buegel

[11] Patent Number: 5,113,603

[45] Date of Patent: May 19, 1992

[54] THUMB RELEASE FOR PISTOL MAGAZINE

[76] Inventor: John F. Buegel, P.O. Box 1252, Grand Forks, N. Dak. 58206-1252

[21] Appl. No.: 777,996

[22] Filed: Oct. 17, 1991

[51] Int. Cl.[5] ..... F41A 9/61

[52] U.S. Cl. ..... 42/7

[58] Field of Search ..... 42/7; 89/195, 196

[56] References Cited

U.S. PATENT DOCUMENTS

| | | | |
|---|---|---|---|
| 1,187,888 | 6/1916 | Diehm | 42/7 |
| 1,405,685 | 2/1922 | Hammond | 42/7 |
| 1,407,959 | 2/1922 | Stokke | 42/7 |
| 1,452,042 | 4/1923 | Hammond | 42/7 |
| 1,911,494 | 5/1933 | Floyd | 42/7 |
| 2,495,428 | 1/1950 | Simonson et al. | 89/195 |
| 2,975,680 | 3/1961 | Wilson | 89/196 |
| 4,326,353 | 4/1982 | Ludwig et al. | 42/7 |
| 4,521,985 | 6/1985 | Smith et al. | 42/7 |
| 4,747,224 | 5/1988 | Smith | 42/7 |
| 4,759,144 | 7/1988 | Egan et al. | 42/7 |
| 4,835,892 | 6/1989 | Ruger et al. | 42/7 |
| 4,899,476 | 2/1990 | Hindle | 42/7 |
| 4,949,492 | 8/1990 | Clifton, Jr. | 42/7 |

FOREIGN PATENT DOCUMENTS

| | | | |
|---|---|---|---|
| 2618074 | 11/1977 | Fed. Rep. of Germany | 42/7 |

*Primary Examiner*—Charles T. Jordan

*Attorney, Agent, or Firm*—Zarley, McKee, Thomte, Voorhees & Sease

[57] ABSTRACT

A thumb release for pistol magazines includes a kit for modifying a conventional pistol. The modification kit includes a release lever which is mounted for slidable movement within the rectangular opening existing in the handle housing of the pistol. The conventional magazine catch is removed and replaced with a modified magazine catch which has a lever projecting so as to be contacted by vertical movement of the release lever. The grip plate on the pistol handle is substituted with a modified grip plate having an opening through which a thumb rest will project, the thumb rest being connected to the release lever for operation of the release lever.

5 Claims, 4 Drawing Sheets

THUMB RELEASE FOR PISTOL MAGAZINE

TECHNICAL FIELD

The present invention relates generally to automatic pistols, and more particularly to an improved thumb release for the magazine of an automatic pistol.

BACKGROUND OF THE INVENTION

Automatic pistols conventionally utilize a magazine which is insertable in the pistol grip so as to supply bullets to the weapon. At least two models of automatic pistols manufactured by Sturm, Ruger and Co., one currently in production, the other no longer being produced, have been manufactured without a thumb release for the magazine. Thus, it is necessary to use both hands to remove the magazine from the pistol.

It is therefore a general object of the present invention to provide an improved thumb release for the magazine of automatic pistols.

A further object is to provide a three piece kit to modify conventional pistols which are manufactured without a thumb release.

Still another object of the present invention is to provide a thumb release for pistol magazines which is simple to operate and economical to manufacture.

These and other objects will be apparent to those skilled in the art.

SUMMARY OF THE INVENTION

The thumb release for pistol magazines of the present invention includes a kit for modifying a conventional pistol. The modification kit includes a release lever which is mounted for slidable movement within the rectangular opening existing in the handle housing of the pistol. The conventional magazine catch is removed and replaced with a modified magazine catch which has a lever projecting so as to be contacted by vertical movement of the release lever in the rectangular opening. The grip plate on the pistol handle is substituted with a modified grip plate having an opening through which a thumb rest will project, the thumb rest being connected to the release lever to permit vertical slidable movement of the release lever.

DESCRIPTION OF THE PREFERRED EMBODIMENTS

Figure 1:
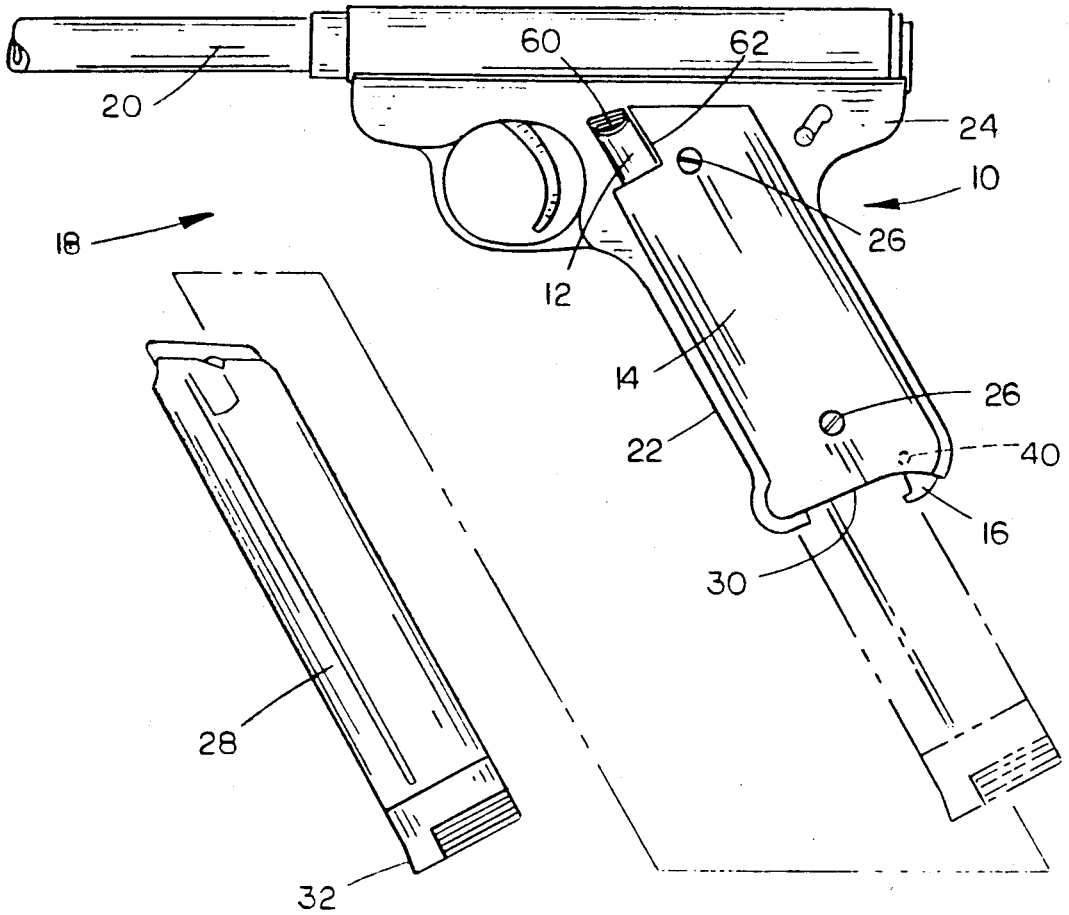
FIG. 1 is a side elevational view of an automatic pistol modified with the thumb release of the present invention.

Referring now to the drawings, in which similar or corresponding parts are identified with the same reference numeral and more particularly to FIG. 1, the thumb release of the present invention is designated generally at 10, and includes three basic components: a release lever 12, a modified grip panel 14 and a modified magazine catch 16.

As shown in FIG. 1, thumb release 10 is applied to a conventional automatic pistol 18 of the type having a barrel 20 and handle 22. A metal frame 24 has a grip plate 14 mounted on each side of handle 22, and fastened in position by screws 26. A magazine 28 will slide within an opening 30 formed in the lower end of handle 22, and has an enlarged base 32 which prevents over insertion of the magazine.

Figure 4:
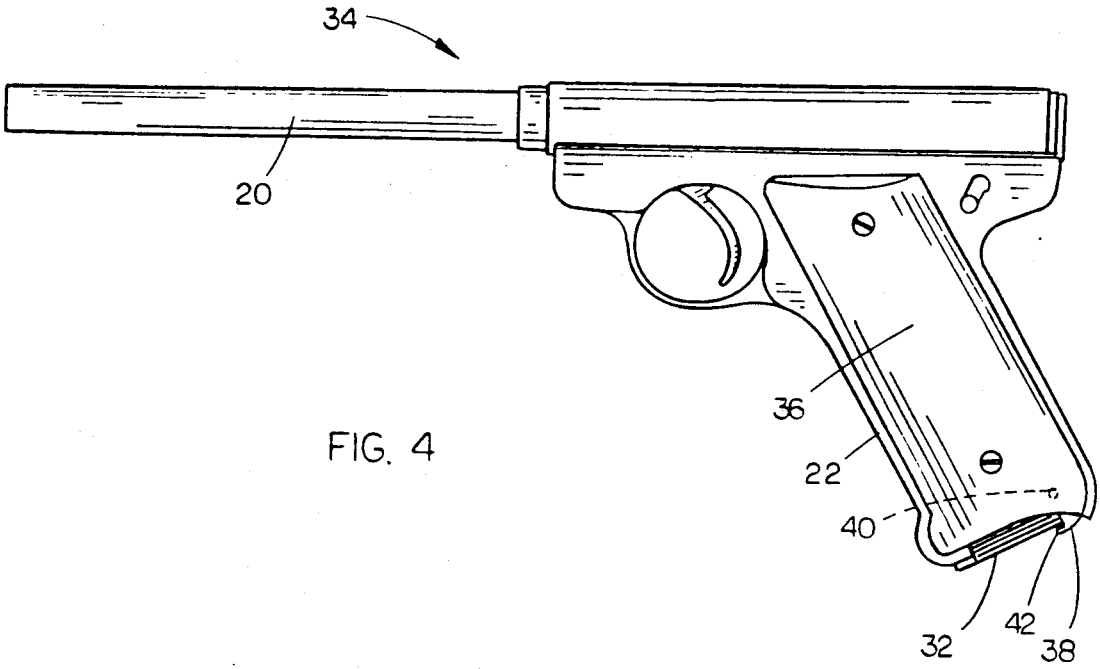
FIG. 4 is a side elevational view of a prior art pistol.

The conventional pistol 34, shown in FIG. 4, also has a barrel 20 handle 22 magazine 32 along with a pistol grip plate 36 and magazine catch 38. The magazine 32 is released from handle 22 in conventional pistol 34 by manually pivoting magazine catch 38 on pin 40 so as to move lip 42 rearwardly, such that magazine 32 will slide downward out of handle 22.

Figure 2:
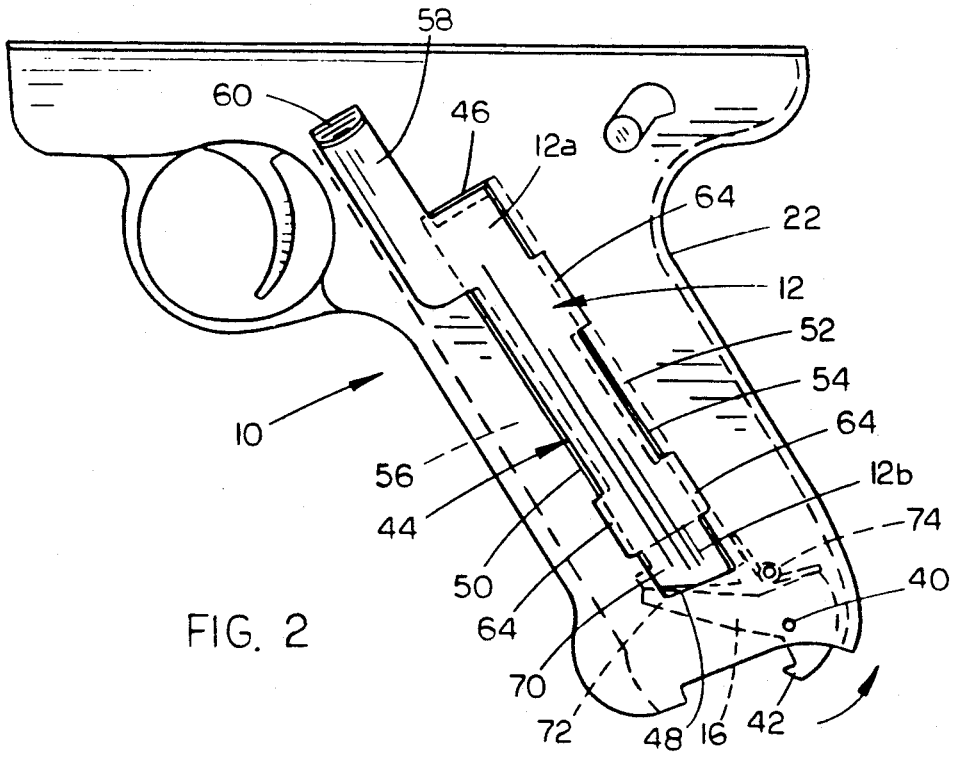
FIG. 2 is an enlarged view of the pistol of FIG. 1, with the pistol grip plate removed to show the components of the present invention.

Referring now to FIG. 2, the left side of the pistol has a large rectangular opening 44 formed therein by cutting along the top edge 46 bottom edge 48 and a forward side edge 50 and bending the outline rectangular metal piece 52 inward into the handle to form rearward side edge 54. Bent piece 52 forms the rearward surface of a magazine well 56 within handle 22.

Figure 3:
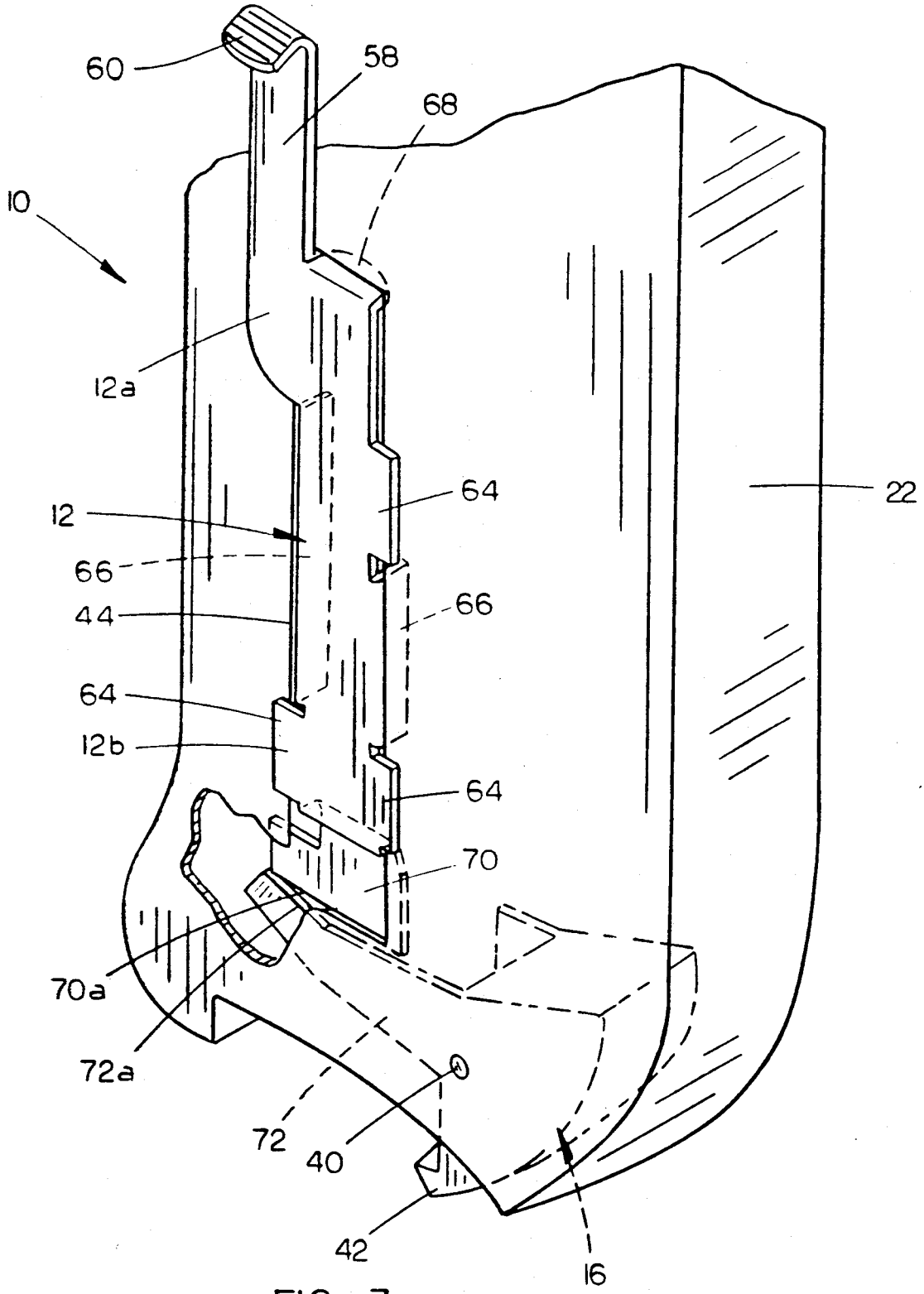
FIG. 3 is an enlarged perspective view of the pistol handle with the grip plate removed.

The thumb release of 10 of the present invention utilizes the existing rectangular opening 44 in handle 22 as a guide for a release lever 12. As shown in FIGS. 2 and 3, release lever 12 is a flat strap of rigid material having an upper end **12*a* and a lower end 12*b* an upwardly projecting arm 58 is mounted on upper end 12*a* of release lever 12, for slidable movement therewith. The upper end of arm 58 is bent outwardly to form a thumb rest 60 which will project from a notch 62 formed in grip plate 14 (as shown in FIG. 1) so as to be actuated by the thumb of a person utilizing pistol 18. Wing portions 64 project outwardly and coplanar with lever 12, beyond the width of rectangular opening 44. A pair of opposing walls 66 are formed at right angles to lever 12 by bending projecting wings rearwardly, to form vertical guides which fit within the width of opening 44. A stop 68 is formed at the upper end 12*a* of lever 12 by bending a portion of the lever rearwardly to abut the top edge 46 of rectangular opening 44**.

At the lower end of lever **12*b* an arm 70 is formed by bending the lower most portion of release lever 12 rearwardly and then downwardly, so as to lie parallel to the main body of release lever 12. Arm 70 is located interiorly of handle 22 and will slide vertically along with release lever 12. Modified magazine catch 16 is pivotally mounted on pin 40 and has the same lip 42 as conventional magazine catch 38, to retain a magazine 32 in position. Modified magazine catch 16 differs from the conventional catch by the addition of projecting lever 72 which extends coplanar with arm 70 of release lever 12. The upper edge 72*a* of lever 72 is oriented at an angle with respect to the bottom edge 70*a* of arm 70 when magazine catch 16 is in the "locked" position (as shown in FIGS. 1, 2 and 3). Vertical downward sliding movement of release lever 12 will cause arm 70 to move downwardly against lever 72 so as to pivot magazine catch 16 on pin 40 and thereby move lip 42 rearwardly to release magazine 32**.

Thus, to modify a conventional pistol, such as that shown in FIG. 4, the grip plate 36 is removed from handle 22 to allow access to the magazine catch pivot pin 40. Pin 40 is removed so as to permit removal of the conventional magazine catch 38 from handle 22. As shown in FIG. 2, the modified magazine catch 16 is then pivotally connected to handle 22 utilizing the existing pin 40. It should be noted that a spring 74 is mounted with handle 22 to bias magazine catch 38 (and modified magazine catch 16) into the locked position. Release lever 12 is then journaled into rectangular opening 44 with arm 70 located on the interior of the magazine well coplanar with lever 72 of magazine catch 16. The modified grip plate 14 then replaces the conventional grip plate 36 utilizing screws 26. As shown in FIG. 1, release lever 12 is fabricated so that thumb rest 60 is located in close proximity to the right thumb when pistol 18 is properly held by a right handed shooter. Downward pressure on thumb rest 60 will thereby pivot magazine catch 16 against the bias of spring 74 (see FIG. 2) to permit the release of magazine 28.

Figure 5:
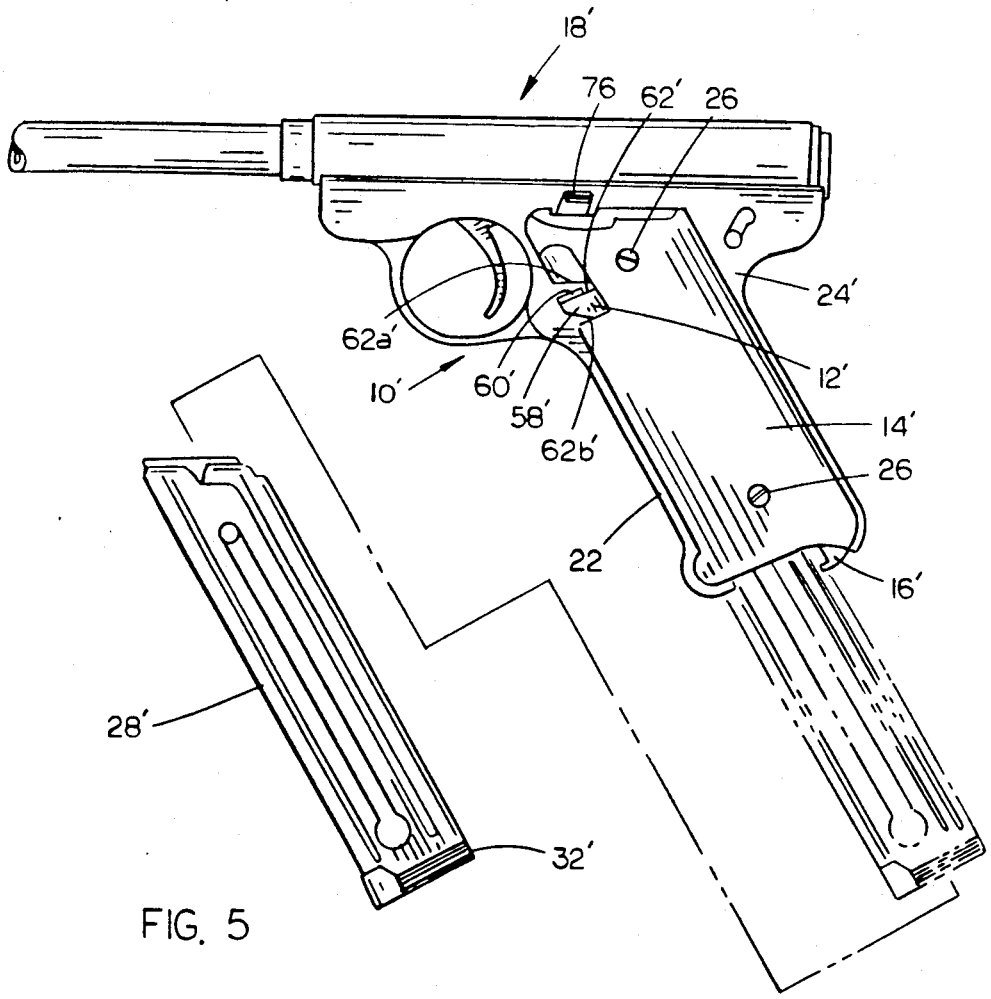
FIG. 5 is a side elevational view of a second embodiment of the invention mounted on a second embodiment of a pistol.
Figure 6:
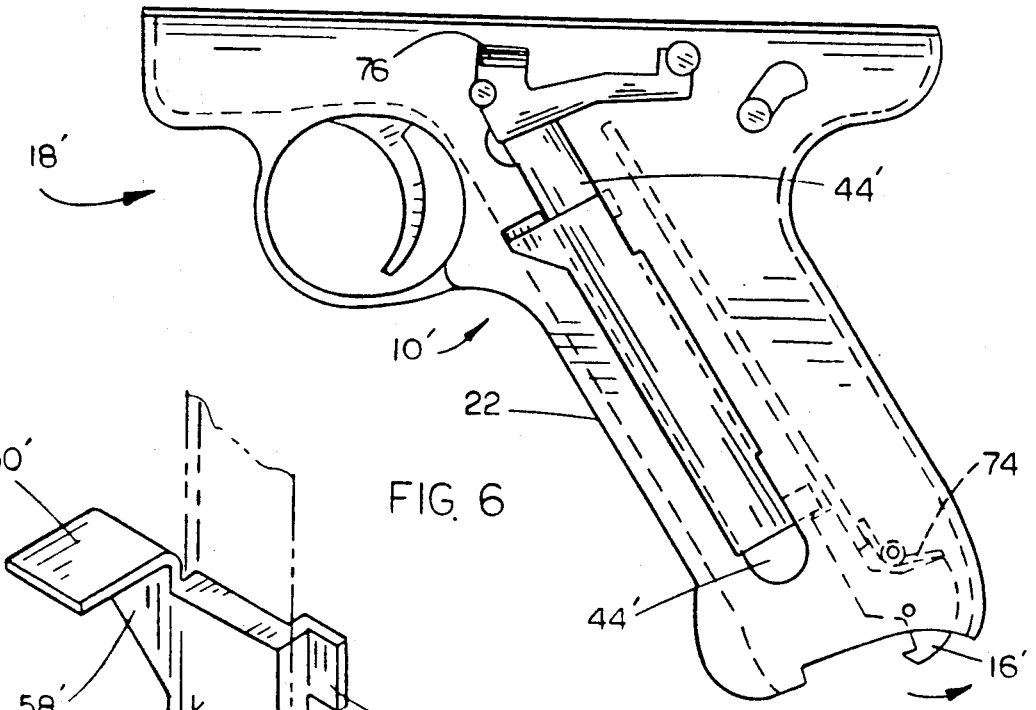
FIG. 6 is an enlarged view of FIG. 5 with the pistol grip removed to show the components of the invention.
Figure 7:
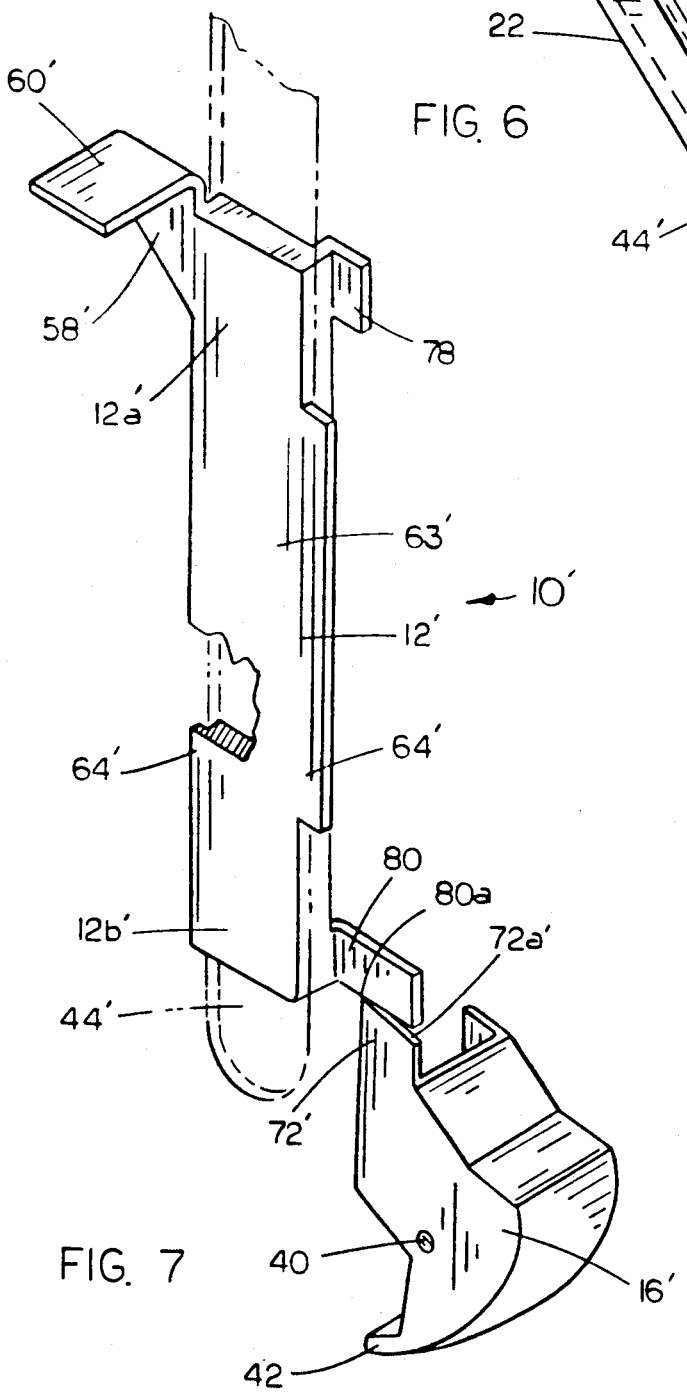
FIG. 7 is an enlarged perspective view of a portion of the thumb release of the present invention.

Referring now to FIGS. 5-7, a second embodiment of the thumb release of the present invention is designated generally at 10' and is designed for a modified version of pistol 18'. Pistol 18' is converted at a similar method, but because of a change in the magazine 28' and frame 24' design, the release lever 12', magazine catch 16' and grip panel 14' are specially modified. As shown in FIGS. 5 and 6, pistol 18' has a bolt hold-open device 76 located at the upper end of the rectangular opening 44' in a location which would interfere with the release lever 12 of the previous embodiment. In addition, rectangular opening 44' is slightly narrower and located more towards the front of handle 22 of pistol 18', as shown in FIG. 6.

Referring now to FIG. 7, release lever 12' has a generally flat planar body portion 63' with projecting wing portions 64' which will project past the width of rectangular opening 44'. Preferably, body portion 63' is thicker than wing portion 64', and has a width slightly less than the width of rectangular opening 44', so as to slide vertically within the slot, with wing portions 64' acting as guides. An arm 58' projects forwardly from the upper end **12*a'* of release lever 12' and has a thumb rest 60' projecting outwardly therefrom through a notch 62' formed in grip panel 14'. Notch 62' has an upper edge 62*a'* and a lower edge 62*b'* which serve as stops for movement of thumb rest 60'** upwardly and downwardly.

Interiorly mounted upper and lower wing portions 78 and 80 respectively will abut the interior of the pistol grip frame 24 with wing portions 64' abutting the exterior, so as to guide release lever 12' along rectangular opening 44'. Because rectangular opening 44' is located more forwardly on handle 22 than the previous embodiment, the modified magazine catch 16' has a lever 72' which is oriented generally parallel to slot 44', rather than transversely and below the slot as shown in the previous embodiment. The upper edge **72*a'* of lever 72' is oriented so as to contact the lower edge 80*a* of lower wing 80, and is preferably formed with a slight angle to assist in pivoting magazine catch 16' about pin 40 when release lever 12' is moved downwardly. As in the previous embodiment, pressure on thumb rest 60' will slide release lever 12' downwardly such that wing 80 will contact lever 72' and pivot magazine catch 16' on pin 40 to move lip 42 out of engagement with the base 32' of magazine 28'**, thereby permitting the release of the magazine.

The method for installing the second embodiment of the thumb release 10' is the same as previous embodiment. The original grip plate is removed from handle 22, as is the original magazine catch. Modified magazine catch 16' is installed with pin 40 and then release lever 12' is inserted in rectangular opening 44'. Modified grip plate 14' is then affixed to handle 22 with screws 26.

Whereas the invention has been shown and described in connection with the preferred embodiments thereof, it will be understood that many modifications, substitutions and additions may be made which are within the intended broad scope of the appended claims. There has therefore been shown and described an improved thumb release for pistols which accomplishes at least all of the above stated objects.

I claim:

1. A thumb release for the modification of a conventional automatic pistol of the type having a releasable magazine selectively held in position by an operable magazine catch, a hollow handle frame with a generally vertically oriented rectangular opening through a first side thereof, a magazine well within the handle, removable grip plates on the sides of said handle frame and covering said rectangular opening, said magazine catch pivotally mounted on a removable pivot pin, comprising:

a generally planar release lever adapted for slidable mounting in said rectangular opening, to slide vertically therealong;

said release lever having a thumb rest portion projecting generally perpendicularly outwardly from the upper end thereof;

a modified magazine catch adapted for pivotal mounting on said pivot pin, said modified magazine catch comprising:

a hook-shaped lip for retaining said magazine in the magazine well when the catch is pivoted to a locked position, and which pivots rearwardly away from the magazine to release the magazine when the catch is pivoted to a release position;

a lever projecting from said catch of a length to be positioned immediately adjacent and below the lower end of said release lever, such that the release lever will contact the projecting lever to pivot the catch from the locked position to the release position when the release lever is moved downwardly;

a modified grip plate for covering the side of said handle frame with said rectangular opening, having a notch formed therein through which said thumb rest will project when mounted on a pistol handle.

2. In combination:

an automatic pistol having a hollow handle frame with opposing first and second vertical sides, a forward side, a rearward side, and a bottom;

said handle frame having an opening in the bottom to receive a magazine, and a magazine well formed within said handle frame;

a generally vertically oriented rectangular opening in the first side, having upper and lower ends and forward and rearward vertical sides;

a magazine slidably and releasably mounted within the magazine well of said handle, said magazine having an enlarged base portion;

a magazine catch pivotally mounted within said handle frame for movement between a locked position and a release position;

said magazine catch including a hook-shaped lip positioned to engage the magazine base when the catch is in the locked position, and pivot away from engagement when the catch is in the release position, to selectively retain the magazine in position in the handle;

a release lever having upper and lower ends, slidably mounted in said rectangular opening for movement between an upper position and a lower position, the lower end of said release lever located to engage and move the catch from the locked position to the release position when the release lever is moved from the upper position to the lower position;

said release lever having a thumb rest projecting outwardly generally perpendicular to the handle frame, at the upper end thereof.

3. The combination of claim 2, further comprising a grip plate removably secured to said first handle side, having dimensions to cover said release lever, said grip plate having a notch formed therein through which said thumb rest portion projects.

4. The combination of claim 2, further comprising spring means for biasing some catch into the locked position.

5. A method for modifying a conventional automatic pistol, comprising the steps of:

providing a pistol of the type having:

a hollow handle frame with opposing first and second vertical sides, and a bottom;

said handle frame having an opening in the bottom to received a magazine, and a magazine well formed within the handle frame;

a generally vertically oriented rectangular opening in the first side, having upper and lower ends and forward and rearward vertical sides;

a magazine slidably and releasably mounted within the magazine well of the handle, having an enlarged base portion;

a magazine catch pivotally mounted on a removable pivot pin within said handle frame between said first and second sides, for movement between a locked position and a release position;

said magazine catch including a hook-shaped lip positioned to engage the magazine base when the catch is in the locked position, and to pivot away from engagement when the catch is in the released position to selectively retain the magazine in position in the handle;

first and second grip plates removably secured to the first and second sides of said hollow housing;

removing said first grip plate from the first side of said handle frame;

removing the magazine from the magazine well;

removing the pivot pin and magazine catch from said handle frame;

installing a modified magazine catch on said pivot pin and installing said pivot pin within said handle, said modified magazine catch including a hook-shaped lip positioned to selectively engage the magazine base, and further comprising an elongated projecting lever for pivotal movement with said catch;

slidably mounting a release lever in said rectangular opening for slidable movement between upper and lower positions, the release lever having upper and lower ends with the lower end of the release lever located to engage and move the projecting arm of the modified catch, to pivot the modified catch from a locked position to a release position when the release lever is moved from the upper position to a lower position, said release lever having a thumb rest projecting outwardly generally perpendicular to the handle frame, at the upper end thereof; and installing a modified grip plate on said first side of said handle frame, said modified grip plate having a notch formed therein through which said thumb rest will project.

* * * * *